US011757187B2

(12) United States Patent
Mezzadrelli et al.

(10) Patent No.: US 11,757,187 B2
(45) Date of Patent: Sep. 12, 2023

(54) WIDE BAND DIRECTIONAL ANTENNA

(71) Applicant: SIRIO ANTENNE S.r.l., Volta Mantovana (IT)

(72) Inventors: Lorenzo Mezzadrelli, Mantova (IT); Mercurio D'Aleo, Volta Mantovana (IT); Vittorio Loi, Villagrande Strisaili (IT); Luigi Corrà, Marano Vicentino (IT)

(73) Assignee: SIRIO ANTENNE S.R.L., Volta Mantovana (IT)

( * ) Notice: Subject to any disclaimer, the term of this patent is extended or adjusted under 35 U.S.C. 154(b) by 0 days.

(21) Appl. No.: 17/706,195

(22) Filed: Mar. 28, 2022

(65) Prior Publication Data

US 2022/0336950 A1 Oct. 20, 2022

(30) Foreign Application Priority Data

Mar. 31, 2021 (IT) ..... 102021000008060

(51) Int. Cl.

| | |
|---|---|
| ***H01Q 5/49*** | (2015.01) |
| ***H01Q 9/28*** | (2006.01) |
| ***H01Q 5/10*** | (2015.01) |
| ***H01Q 5/321*** | (2015.01) |

(52) U.S. Cl.

CPC ..... *H01Q 5/49* (2015.01); *H01Q 5/10* (2015.01); *H01Q 5/321* (2015.01); *H01Q 9/285* (2013.01)

(58) Field of Classification Search

CPC ..... H01Q 5/49; H01Q 9/0414; H01Q 9/285

See application file for complete search history.

(56) References Cited

U.S. PATENT DOCUMENTS 3,710,337 A * 1/1973 Grant ..... H01Q 5/00 455/275

4,604,628 A 8/1986 Cox (Continued)

FOREIGN PATENT DOCUMENTS

| | | | | |
|---|---|---|---|---|
| CN | 1881685 A | | 12/2006 | |
| CN | 111799569 A | * | 10/2020 | ..... H01Q 1/22 |
| CN | 108232467 B | * | 2/2021 | ..... H01Q 1/2208 |

(Continued)

OTHER PUBLICATIONS

Italian Search Report dated Feb. 21, 2022 from counerpart Italian Patent Application No. 102021000008060.

(Continued)

*Primary Examiner* — Dameon E Levi
*Assistant Examiner* — Leah Rosenberg
(74) *Attorney, Agent, or Firm* — SHUTTLEWORTH & INGERSOLL, PLC; Timothy Klima

(57) ABSTRACT

A wide band directional antenna includes three elements which are partially aligned, electrically isolated from each other, of which a lower element includes at least one reflector circuit, a middle element comprises at least one dipole circuit connected to a transmission line, and an upper element includes a director circuit, wherein the dipole circuit includes at least one first pair of conductive elements, suitable for forming a minor dipole connected to the transmission line, and at least one second pair of electrically isolated conductive elements, excited with capacitive effect by the minor dipole, in such a way as to form a major dipole.

18 Claims, 4 Drawing Sheets

(56) References Cited

U.S. PATENT DOCUMENTS

| | | | | |
|---|---|---|---|---|
| 6,087,989 | A * | 7/2000 | Song | H01Q 21/08 343/803 |
| 2011/0241960 | A1 * | 10/2011 | Lu | H01Q 19/30 343/833 |

FOREIGN PATENT DOCUMENTS

| | | | |
|---|---|---|---|
| KR | 101997698 | B1 | 7/2019 |
| WO | WO-2021192560 | A1 * | 9/2021 |

OTHER PUBLICATIONS

European Search Report dated Aug. 25, 2022 from counterpart European Patent Application No. 22020138.8.

* cited by examiner

WIDE BAND DIRECTIONAL ANTENNA

This application claims priority to Italian Patent Application 102021000008060 filed Mar. 31, 2021, the entirety of which is incorporated by reference herein.

BACKGROUND OF THE INVENTION

This invention relates to a wide band directional antenna, particularly suitable for transmitting and receiving radio frequency signals by using a plurality of bands used in the sector of mobile communication standards, especially in the sector of 4G and 5G standards.

The most widespread directional antennas are the so-called Yagi antennas (named after their inventor), composed of a radiating component, made up of one or more dipoles, and one or more parasitic components (that is to say, not directly excited), the reflector and/or the director, whose purpose is to improve the intensity and orientation of the signal transmitted or received in the direction of the dipole.

Nowadays, the demand for increasingly high performance with reference to the various telecommunications sectors means that there is a need to increase the frequency bands used and, in some cases, to expand the frequency bands already previously used.

As a result of that need, wide band products have been brought to market, that is to say, products capable of simultaneously covering multiple frequency bands, which are capable of fulfilling the functionalities associated with multiple separate frequency bands. Those antennas have a structure with dipoles, making it possible to cover multiple commercial frequency bands, in such a way as to use them for different communication services with regard to the specific use requirements.

In parallel, even in the sector of antennas there is a tendency to favor construction solutions which have compact dimensions, which are preferable both from the use of materials viewpoint, and the convenience and ease of installation viewpoint.

The wide band antennas currently available on the market have several practical problems: first, the dimensions are often considerable; second, they are affected by strong mutual inductance currents between the dipoles, at the various frequencies, with consequent narrowing of the frequency bands obtainable and less usability of the antenna itself, with regard to the communication services which must be covered by a predetermined band. Other antennas, with more compact dimensions, are not capable of covering all of the frequency bands, particularly among the lower ones used by the 4G and 5G communication standards.

SUMMARY OF THE INVENTION

The aim of this invention is therefore to eliminate the above-mentioned disadvantages and limitations.

The invention, characterized as set out in the claims, achieves the aim thanks to a particular configuration of the radiating component, which consists of a plurality of dipoles.

The main advantage obtained by means of this invention basically consists of the fact that it is particularly compact, above all compared with directional antennas for 4G and 5G telephony currently on the market, despite maintaining good impedance adjustment for multiple frequency bands, especially at the lower frequencies, below 1000 MHz.

Moreover, the invention allows very high levels of gain to be achieved, of between approximately 6 dBi for the lower frequency bands and up to approximately 13 dBi for the higher frequency bands, around several thousand MHz.

BRIEF DESCRIPTION OF THE DRAWINGS

Further advantages and features of the invention will be more apparent in the detailed description which follows, with reference to the accompanying drawings, which show an example, non-limiting embodiment, in which.

DESCRIPTION OF THE PREFERRED EMBODIMENTS

Figure 1:
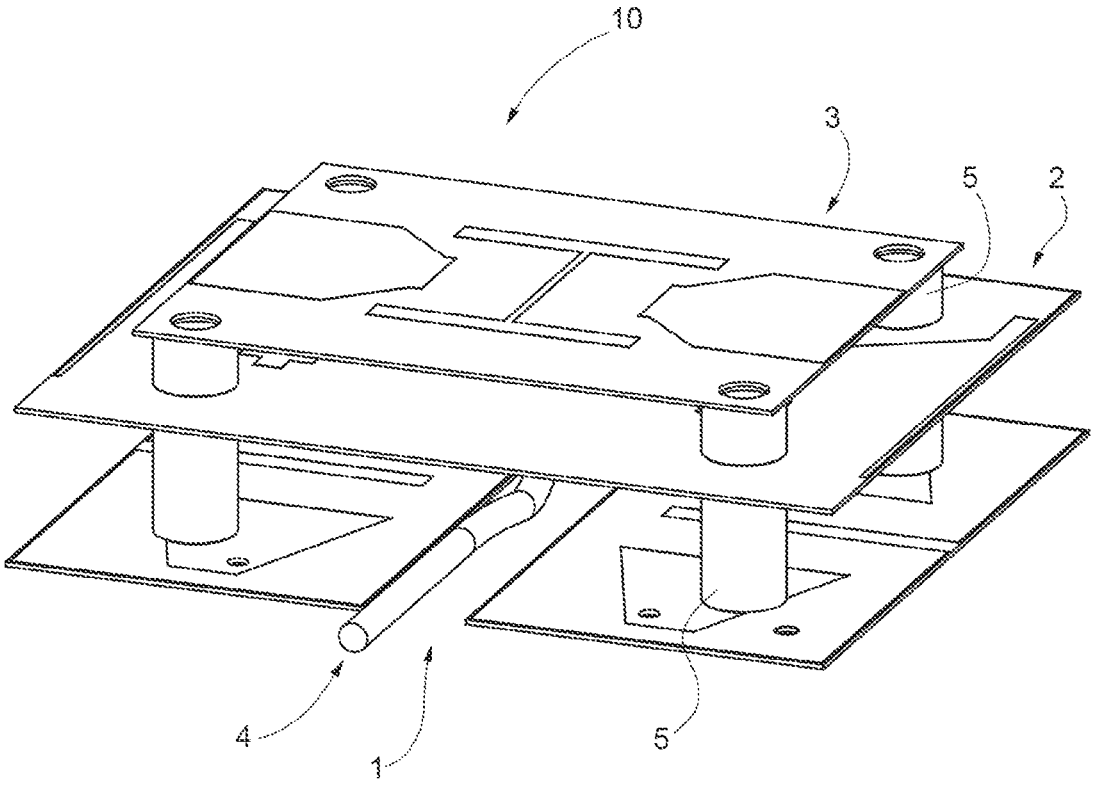
FIG. 1 illustrates the invention according to a perspective assembly view, with some parts cut away to better illustrate others.
Figure 2:
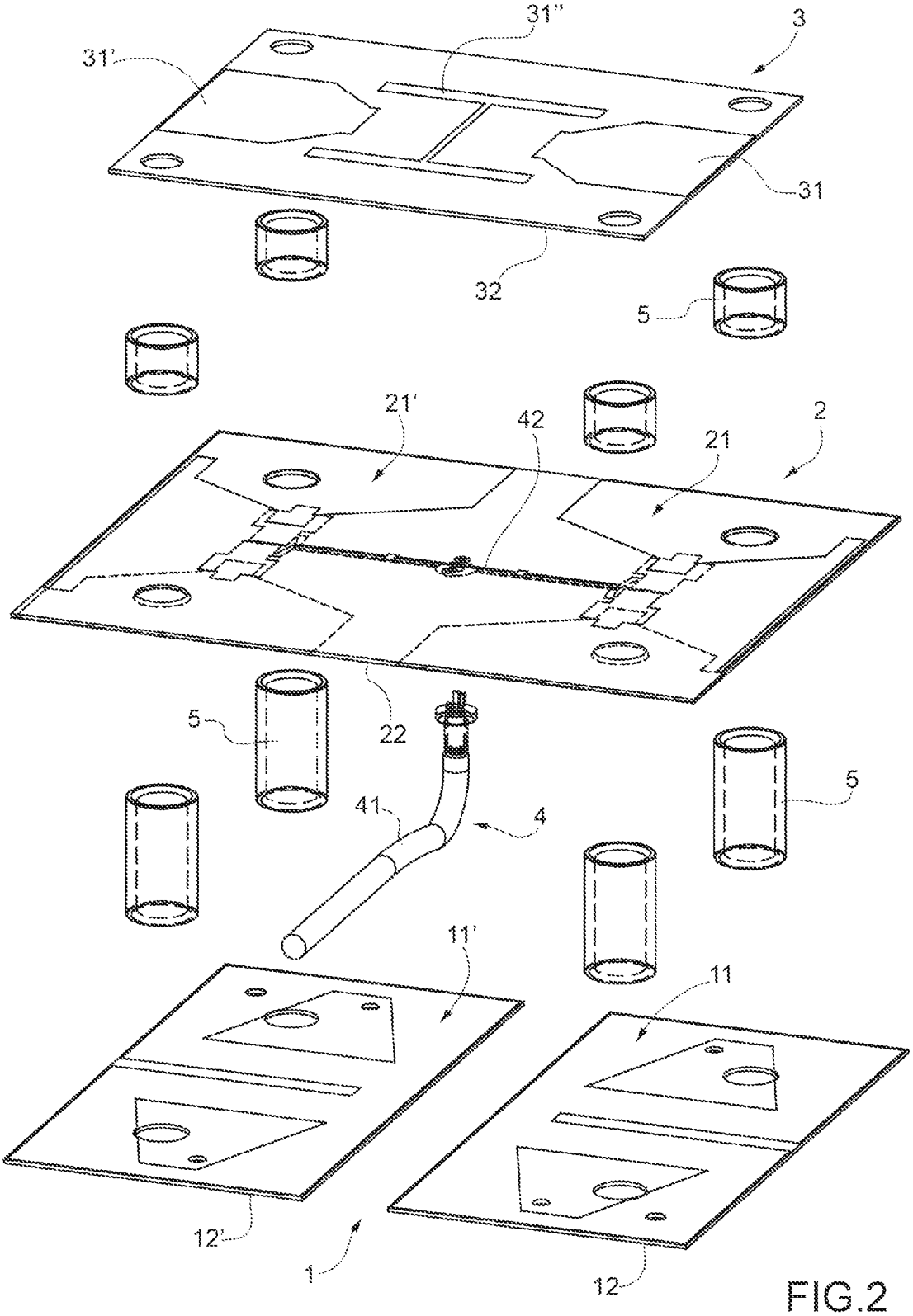
FIG. 2 illustrates the invention according to the view in FIG. 1 exploded.

As seen in the figures, the invention relates to a wide band directional antenna, particularly suitable for transmitting and receiving radio frequency signals operating in the mobile communication standards sector, particularly 4G and 5G. In this specific use, the invention allows use to be made of many frequency bands included in a vast range which goes from frequencies below 1000 MHz, for example the band included between 698 and 960 MHz, up to frequencies higher than 3000 MHz and beyond, for example the band included between 3300 and 3800 MHz. However, that does not compromise use of the invention even for other frequency bands used for this and other purposes, such as, for example, WiFi transmissions, next generation cellular networks or other single-band or multi-band communication standards used in civilian, military, industrial, medical or other sectors. The antenna 10, shown in an assembly configuration without the containment structure, comprises at least three elements 1, 2, 3 which are at least partially aligned, electrically isolated from each other, of which a lower element 1 comprises at least one reflector circuit 11, a middle element 2 comprises at least one dipole circuit 21 connected to a transmission line 4, and an upper element 3 comprises at least one director circuit 31. The three elements 1, 2, 3, visible in the exploded view of FIG. 2, are preferably made in the form of supporting plates 12, 22, 32 made of insulating material, for example Vetronite, on which the conductive material has been deposited, for example copper, which forms the above-mentioned circuits 11, 21, 31, intended to perform different electromagnetic functions.

The reflector circuit 11 reflects the electromagnetic field which strikes it; the dipole circuit 21, connected to the transmission line 4 transmits and receives the signal of interest from and to a telecommunications unit, not shown here; the director circuit 31 promotes the propagation of the electromagnetic field arriving from the dipole circuit 21 and from the reflector circuit 11 in a predetermined direction.

Figure 3A:
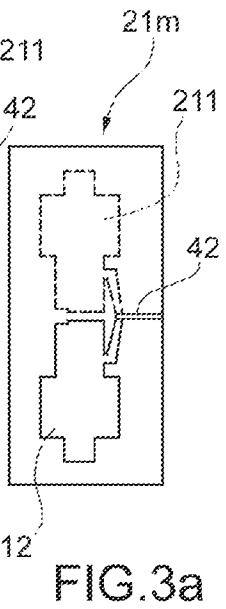
FIG. 3*a* illustrates a detail of FIG. 3.
Figure 3B:
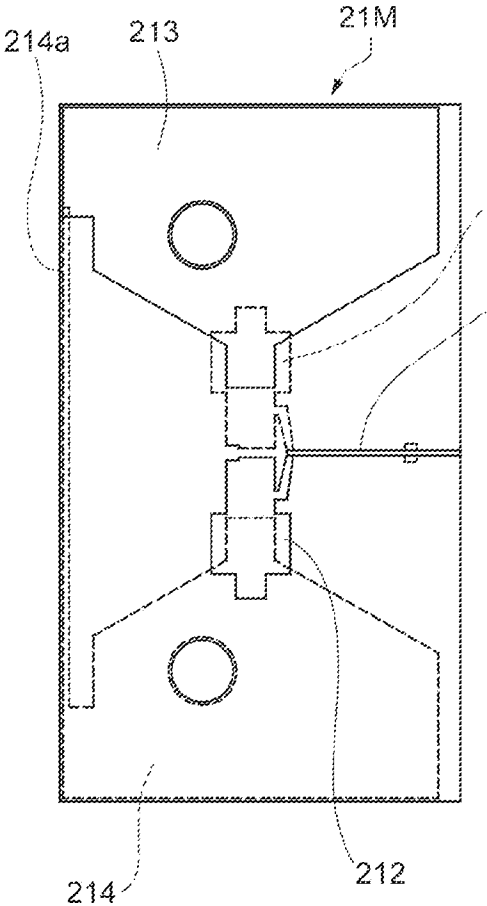
FIG. 3*b* illustrates a detail of FIG. 3.
Figure 3:
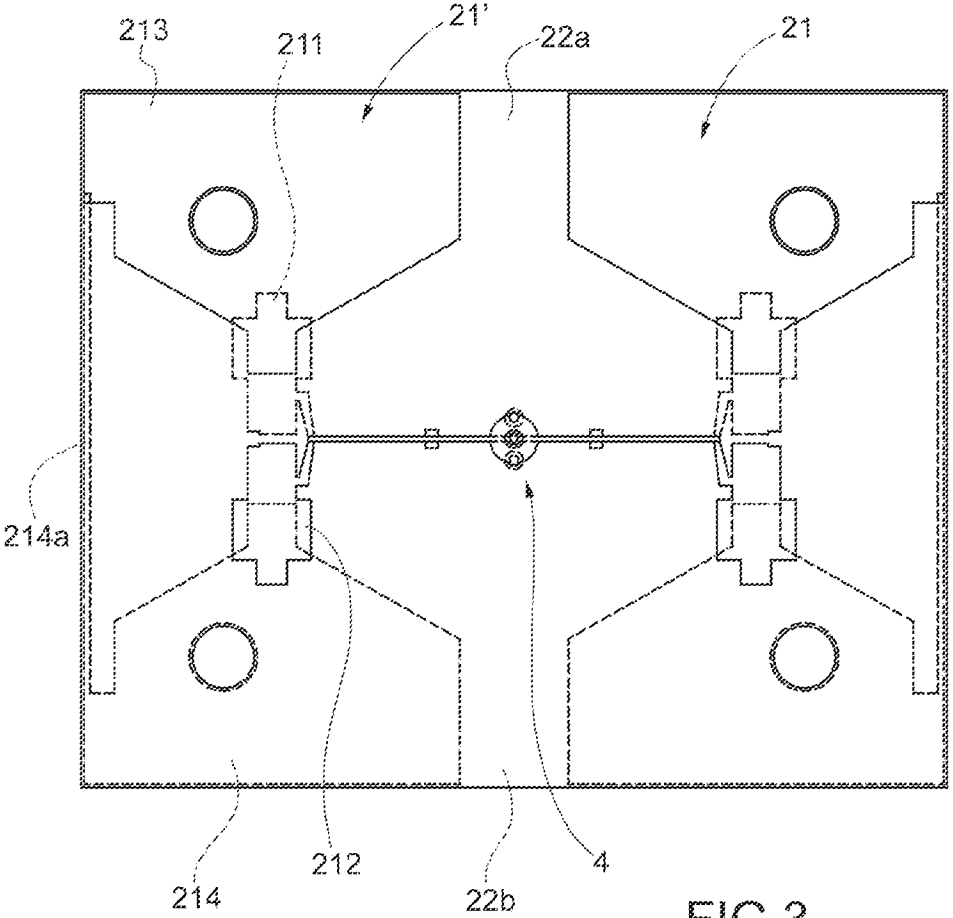
FIG. 3 illustrates a detail of the invention.

In a preferred embodiment of the antenna 10, the dipole circuit 21, shown in FIG. 3, comprises at least one first pair of conductive elements 211, 212, suitable for forming a minor dipole 21*m* connected to the transmission line 4, shown in FIG. 3*a*, suitable for supplying functionality at the higher frequency bands, and at least one second pair of electrically isolated conductive elements 213, 214, excited with capacitive effect by the minor dipole 21*m*, a phenomenon made possible by the small thickness of the supporting plate 22 and by the partial superposing, on the two faces 22*a*, 22*b* of the plate 22, of the conductive elements 211, 213; 212, 214. The set formed by the minor dipole 21*m* and by the second pair of conductive elements 213, 214 thereby forms a major dipole 21M, shown in FIG. 3*b*, suitable for supplying functionality at the central and lower frequency bands, for example those between 1710 and 2690 MHz and between 698 and 960 MHz.

In the embodiment shown in the figures, the antenna 10 comprises two identical and specular dipole circuits 21, 21', which are connected to the transmission line 4, here composed of a coaxial cable 41 and two double-wire lines 42, which allow the signal to be split or formed equally between the two dipoles 21, 21'. The set of dipoles 21, 21' fed in this way forms an "antenna array", allowing an increase in the overall gain and improving the directional feature of the antenna.

Moreover, it is advantageous for at least one electrically isolated conductive element 214 to comprise a bent extension 214*a* parallel to the body of the major dipole 21M, in such a way as to favor impedance adjustment at the lower frequencies, and having a length such that it reaches the electrically isolated second conductive element 213 in such a way as to form a capacitive coupling.

Figure 4:
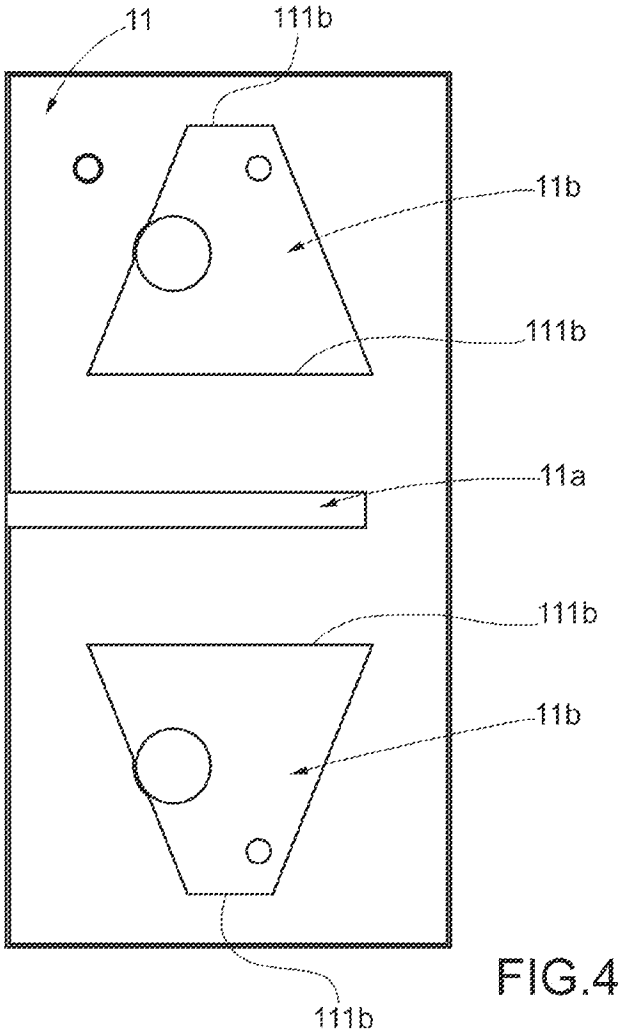
FIG. 4 illustrates a second detail of the invention.

The lower element 1, shown in FIG. 4, comprises two reflector circuits 11, 11', placed on two separate plates 12, 12', substantially specular and electrically isolated from each other in order to reduce the coupling between the dipoles 21, 21' above, particularly at the lower frequency bands. Each of them comprises a cut 11*a* which is transversal relative to the dipoles 21*m*, 21M, and at least partially aligned with the transmission line 4, in such a way as to extend the path of the currents and to maintain electrical continuity, making it suitable for supplying functionality at the lower frequency bands.

The reflector circuit 11 comprises at least one non-conductive island 11*b*, with a substantially polygonal shape, in such a way as to improve the behavior of the reflector circuit 11 at the higher frequency bands. In the example shown in the figures, the reflector circuits 11, 11' each comprise two islands 11*b* which are positioned symmetrically relative to the transversal cut 11*a*, having a quadrangular shape and preferably trapezoidal, wherein the two parallel sides 111*b* are sized in order to allow the functionality of the reflector circuit 11 for two different frequency bands, whose quarter wavelength substantially corresponds to the lengths of the parallel sides 111*b*.

Figure 5:
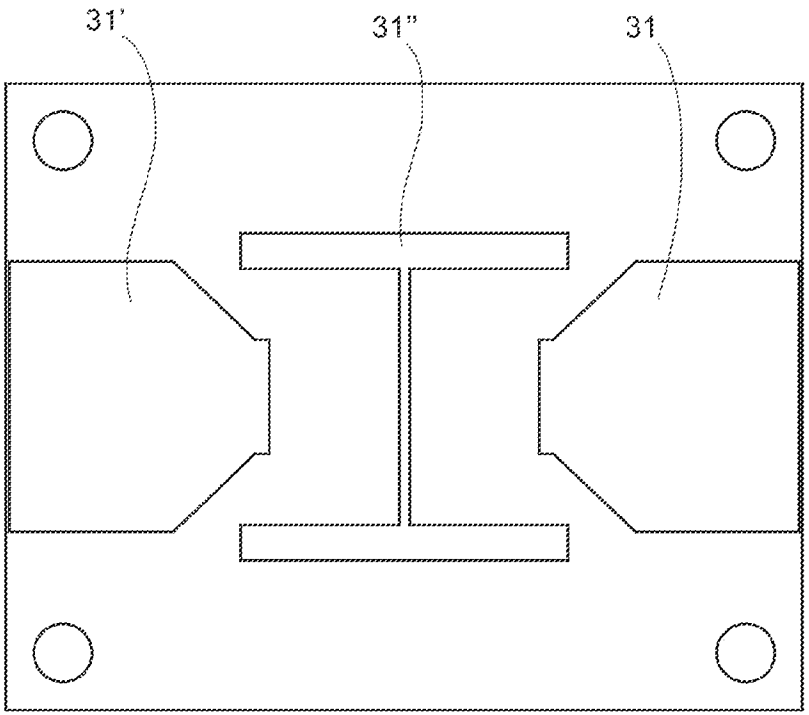
FIG. 5 illustrates a third detail of the invention.

The upper element 3, shown in FIG. 5, also preferably comprises two substantially symmetrical director circuits 31, 31', in such a way that each faces a dipole 21, 21'. The director circuits 31, 31' have a trapezoidal shape, in such a way as to improve the behavior of the director circuit 31 at the higher frequency bands and to bring the dipole circuit 21 back to resonance. In fact, a dipole circuit 21 is resonant when voltage and current are in phase at the point of connection to a transmission line 4, since in this condition the antenna impedance is purely real and transmission occurs easily; feeding with capacitive effect of the major dipole 21M introduces a phase inversion which takes the resonance frequency outside the frequencies of interest, rendering the dipole circuit 21 no longer resonant. A director circuit 31 shaped in this way and placed at a suitable distance from the dipole circuit 21 adds a further capacitive contribution which allows the dipole circuit 21 to become resonant again at central frequency bands, for example between 1710 and 2700 MHz.

The upper element 3 also comprises a horizontal "H"-shaped third director circuit 31", in order to improve impedance adjustment at the lower frequency bands, for example between 698 and 960 MHz.

A plurality of spacers 5, suitable for separating the middle element 2 from the lower element 1 and from the upper element 3 allows the efficiency of the antenna 10 to be optimized, sizing it depending on the frequency bands to be used.

What is claimed is:

1. A wide band directional antenna, comprising:

a transmission line, at least three elements which are at least partially aligned in a stack configuration, electrically isolated from each other, the at least three elements including:

a lower element comprising at least one reflector circuit, a middle element comprising at least one dipole circuit connected to the transmission line, and an upper element comprising at least one director circuit, wherein the at least one dipole circuit comprises at least one first pair of conductive elements, for forming a minor dipole connected to the transmission line, and at least one second pair of electrically isolated conductive elements, excited with capacitive effect by the minor dipole, to form a major dipole, a first element of the at least one first pair of conductive elements and a first element of the at least one second pair of electrically isolated conductive elements at least partially overlapping one another, and a second element of the at least one first pair of conductive elements and a second element of the at least one second pair of electrically isolated conductive elements at least partially overlapping one another.

2. The antenna according to claim 1, and further comprising two identical dipole circuits connected to the transmission line, to form an antenna array.

3. The antenna according to claim 1, wherein at least one of the first and second elements of the at least one second pair of electrically isolated conductive elements comprises a bent extension parallel to a body of the major dipole, to favor impedance adjustment at a lower frequency band.

4. The antenna according to claim 3, wherein the bent extension reaches the second element of the at least one second pair of electrically isolated second conductive elements to form a capacitive coupling.

5. The antenna according to claim 1, wherein the transmission line comprises a coaxial cable and at least one double-wire line, for connection to the antenna.

6. The antenna according to claim 1, wherein the at least one reflector circuit of the lower element comprises two reflector circuits which are substantially specular and electrically isolated from each other.

7. The antenna according to claim 1, wherein the at least one reflector circuit comprises a cut which is transversal relative to the dipoles, and at least partially aligned with the transmission line, to extend a path of the currents and to maintain electrical continuity.

8. The antenna according to claim 1, wherein the at least one reflector circuit comprises at least one non-conductive island, with a substantially polygonal shape, to improve the behavior of at least one reflector circuit at a higher frequency band.

9. The antenna according to claim 8, wherein the at least one non-conductive island has a quadrangular shape.

10. The antenna according to claim 8, wherein the at least one non-conductive island includes two parallel sides which are sized to allow functionality of the at least one reflector circuit for two different frequency bands, whose quarter wavelength substantially corresponds to lengths of the two parallel sides.

11. The antenna according to claim 8, wherein the at least one non-conductive island includes two non-conductive islands which are positioned symmetrically relative to a transversal cut separating the two non-conductive islands.

12. The antenna according to claim 1, wherein the upper element comprises two director circuits which are substantially symmetrical, such that each faces one of the dipoles.

13. The antenna according to claim 12, wherein at least one of the director circuits has a trapezoidal shape, to improve behavior of the at least one of the director circuits at a higher frequency band and to bring the at least one dipole circuit back to resonance.

14. The antenna according to claim 1, wherein the upper element comprises a horizontal "H"-shaped third director circuit, to improve impedance adjustment at a lower frequency band.

15. The antenna according to claim 1, and further comprising a plurality of spacers, for separating the middle element from the lower element and from the upper element, to optimize an efficiency of the antenna.

16. A wide band directional antenna, comprising:

a transmission line, at least three elements which are at least partially aligned, electrically isolated from each other, the at least three elements including:

a lower element comprising at least one reflector circuit, a middle element comprising at least one dipole circuit connected to the transmission line, and an upper element comprising at least one director circuit, wherein the at least one dipole circuit comprises at least one first pair of conductive elements, forming a minor dipole connected to the transmission line, and at least one second pair of electrically isolated conductive elements, excited with capacitive effect by the minor dipole, to form a major dipole, wherein the at least one reflector circuit comprises a cut which is transversal relative to the dipoles, and at least partially aligned with the transmission line, to extend a path of the currents and to maintain electrical continuity.

17. A wide band directional antenna, comprising:

a transmission line, at least three elements which are at least partially aligned, electrically isolated from each other, the at least three elements including:

a lower element comprising at least one reflector circuit, a middle element comprising at least one dipole circuit connected to the transmission line, and an upper element comprising at least one director circuit, wherein the at least one dipole circuit comprises at least one first pair of conductive elements, forming a minor dipole connected to the transmission line, and at least one second pair of electrically isolated conductive elements, excited with capacitive effect by the minor dipole, to form a major dipole, wherein the at least one reflector circuit comprises at least one non-conductive island, with a substantially polygonal shape, to improve behavior of the at least one reflector circuit at a higher frequency band, wherein the at least one non-conductive island includes two parallel sides which are sized to allow functionality of the at least one reflector circuit for two different frequency bands, whose quarter wavelength substantially corresponds to lengths of the two parallel sides.

18. The antenna according to claim 17, wherein the at least one non-conductive island includes two non-conductive islands which are positioned symmetrically relative to a transversal cut separating the two non-conductive islands.

* * * * *